US006471441B1

(12) United States Patent
Müller

(10) Patent No.: US 6,471,441 B1
(45) Date of Patent: Oct. 29, 2002

(54) SHEAR-LOAD CHUCK HOLDER

(75) Inventor: Erich Müller, Aarburg (CH)

(73) Assignee: Pecon AG, Lostorf (CH)

( * ) Notice: Subject to any disclaimer, the term of this patent is extended or adjusted under 35 U.S.C. 154(b) by 0 days.

(21) Appl. No.: 09/554,643

(22) PCT Filed: Nov. 16, 1998

(86) PCT No.: PCT/CH98/00493

§ 371 (c)(1),
(2), (4) Date: Aug. 7, 2000

(87) PCT Pub. No.: WO99/25934

PCT Pub. Date: May 27, 1999

(30) Foreign Application Priority Data

Nov. 17, 1997 (CH) ..... 2648/97

(51) Int. Cl.[7] ..... E01C 11/02; E01C 11/04

(52) U.S. Cl. ..... 404/62; 404/47; 404/56; 404/67; 52/585.1

(58) Field of Search ..... 404/47, 48, 51, 404/52, 56, 57, 62, 58, 67; 52/585.1, 586.1, 396.02

(56) References Cited

U.S. PATENT DOCUMENTS

| | | | | | |
|---|---|---|---|---|---|
| 2,194,718 | A | * | 3/1940 | Older | 404/60 |
| 2,323,026 | A | * | 6/1943 | Geyer | 404/60 |
| 2,572,552 | A | * | 10/1951 | Willard | 404/48 |
| 2,608,141 | A | * | 8/1952 | Jacobson | 404/57 |
| 2,654,297 | A | * | 10/1953 | Nettleton | 404/52 |
| 4,091,589 | A | * | 5/1978 | Moot | 52/396.02 |
| 4,578,916 | A | * | 4/1986 | Witschi | 52/396.02 |
| 4,883,385 | A | * | 11/1989 | Kaler | 404/47 |
| 5,005,331 | A | * | 4/1991 | Shaw et al. | 52/396.02 |
| 5,216,862 | A | * | 6/1993 | Shaw et al. | 52/396.02 |
| 5,797,231 | A | * | 8/1998 | Kramer | 52/396.02 |
| 5,852,863 | A | | 12/1998 | Müller et al. | |
| 5,911,538 | A | * | 6/1999 | Muller et al. | 404/60 |
| 6,145,262 | A | * | 11/2000 | Schrader et al. | 52/396.02 |

FOREIGN PATENT DOCUMENTS

| | | |
|---|---|---|
| EP | 032 105 | 7/1981 |
| EP | 765 967 | 7/1998 |
| EP | 773 324 | 7/1998 |

* cited by examiner

*Primary Examiner*—Gary S. Hartmann
(74) *Attorney, Agent, or Firm*—Pauley Petersen Kinne & Erickson

(57) ABSTRACT

A shear-load chuck which is mounted between two members and has a multi-layer structure for transmitting dynamic loads. The multi-layer shear-load chuck is mounted on one surface of a junction like in the traditional bushing of a shear load chuck. A support basket is arranged correspondingly on both sides of the junction and has an end plate as well as at least one strap-like loop. The end plate forms together with the at least one strap-like loop a closed load system. The support basket is attached to the shear-load chuck on one surface of the junction, while it is attached to the bushing on the other surface of the junction. It is further possible to change the cross-sectional shape of the multi-layer shear-load chuck as well as the structural shape of the strap-like loop.

22 Claims, 2 Drawing Sheets

A–A

B–B

C–C

D–D

SHEAR-LOAD CHUCK HOLDER

BACKGROUND OF THE INVENTION

1. Field of the Invention

This invention relates to a shear load dowel mounting for transmitting dynamic loads, having a shear load dowel, a shear load dowel bearing bush and at least one bearing housing holding the bearing bush and one holding the shear load dowel.

2. Description of Related Art

Shear load dowels are connection and compression distribution elements for two concrete parts running in the same plane, which are separated from one another by a gap. From European Patent Reference 0 119 652 a shear load dowel mounting is known, which has a shear load dowel, a shear load dowel bearing bush and a bearing housing holding the bearing bush. Furthermore, on the bearing housing are arranged end plates which fix the shear load dowel bearing bush on a shuttering during the adjustment of the concrete slab. The bearing housing has a multitude of closed loops of reinforcement steel wires. The loops lie in planes parallel to the direction of running of the gap.

Other conventional shear load dowel mountings are known. One of the essential problems of the static shear load dowel mounting is that in the region of the shear load dowels or in the region of the shear load dowel bearing bushes, often the compression limits for concrete are essentially exceeded. This problem may be reduced by increasing the number of shear load dowels in the direction of the running of the expansion gap, but this leads to considerably more costs. A shear load dowel mounting which also resists dynamic loadings is not thus achieved.

A system which with regard to the shear load dowel mounting may also bear up to dynamic loadings is shown in European Patent Reference EP-A-0 032 105. The bearing housings are formed by bowls more or less closed on all sides. Within the bowl, although with this the allowable compression limit of the concrete is exceeded, the force transmission is effected onto the bowl and concrete running above the bowl is relieved so that the allowable compression limit is no longer exceeded.

A further development is shown in European Patent Reference EP-A-0 773 324. Also here is the problem of the static loading and in particular the load distribution for not exceeding the allowable compression limit of the concrete which is taken into account. As a solution, an end plate directed towards the gap is provided, wherein on each end plate there is arranged a plate protruding into the construction body. This plate lies in each case on the side of the dowel or the bush, which with the transmission of the static reaction forces onto the corresponding component lies opposite the compression-loaded side of the dowel or the bush. It is suggested to provide these plates projecting into the construction body so that in an idle manner, on the oppositely lying side, in order to be sure that the element also withstands the static loadings when it is inadvertently installed the wrong way.

SUMMARY OF THE INVENTION

This invention includes a method by which the shear load dowels may be manufactured, which comprise a core reduced free of play and a casing which projects beyond the core and whose ends by way of plastic plugs are protected against corrosion. According to this invention, shear load dowels preferably have relatively inexpensive constructional steel and only have a casing tube of stainless steel. Such shear load dowels have proven themselves extremely well for transmitting static loadings. They may also be precisely manufactured and are protected against corrosion.

It is one object of this invention to provide a shear load dowel mounting which in particular is suitable for dynamic loadings. With this invention, there are shear load dowel mountings on the market which allow for dynamic loadings.

With dynamic loading trials on shear load dowels, as known from European Patent Reference 0 765 967, one has ascertained that in contrast to shear load dowels which have a single mono-ferrite steel, have shown considerably improved dynamic-physical properties. Based on this knowledge further trials with multi-layered shear load dowels have been carried out which all showed improved results over shear load dowels of mono-ferrite material. With this, mono-ferrite shear load dowels are understood as those rods which have a single steel alloy and do not have several layers of equal steel alloys or differing steel alloys.

The invention provides a method for manufacturing shear load dowels since in particular with more than two layers the method is not so suitable.

It is one object of this invention to provide a shear load dowel mounting which is suitable for dynamic loadings.

This object is achieved by a shear load dowel mounting with the features described in the specification and the claims.

For the dynamic shear load dowel mounting the concept of a shear load dowel bearing housing with the features described in the claims as well as multilayered shear load dowel and their common arrangement is of essential importance. For dynamic loadings, these two elements are matched to one another.

BRIEF DESCRIPTION OF THE DRAWINGS

In the accompanying drawings are shown a few embodiment examples of this invention and these are explained by way of the subsequent description wherein:

FIG. 4*b* shows a view as shown in FIG. 1*b* but of the embodiment according to FIG. 4*a.

DESCRIPTION OF PREFERRED EMBODIMENTS

Figure 1A:
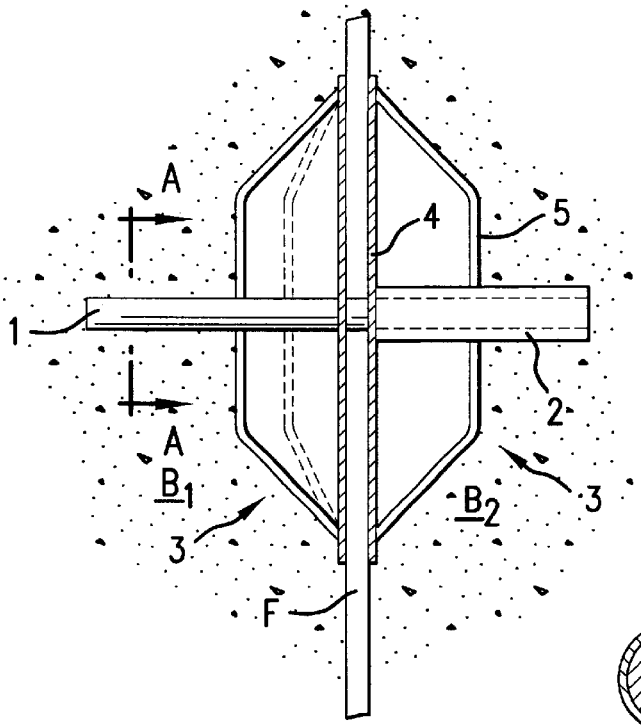
FIG. 1*a* is a vertical longitudinal section taken perpendicular to a direction of the course of the gap.

The two constructional parts which are under dynamic loading and which are connected to one another by way of the shear load dowel mounting are here indicted at $B_1$ and $B_2$. FIG. 1*a* shows the elements deposited in concrete. Essentially the shear load dowel mounting is designed symmetrically with respect to the gap F to be bridged. The shear load dowel mounting includes the shear load dowel 1, a shear load dowel bearing bush 2 as well as bearing housings 3.

Figure 1B:
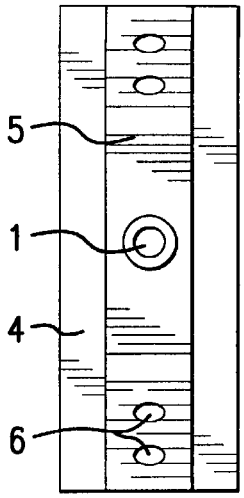
FIG. 1*b* is a rear view of an end plate of the same shear load dowel mounting in which the shear load dowel bearing bush is held.
Figure 1C:
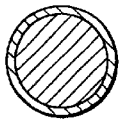
FIG. 1*c* shows a cross section of the shear load dowel taken along the line A—A, as shown in FIG. 1*a;*

The bearing housings 3 have at least two elements, specifically an end plate 4 and a strap-like loop 5. The strap-like loop 5 with the end plate 4 together form a closed force system. The end plate 4 is admitted in the concrete flush with the end surface of the respective concrete part $B_1$, $B_2$, which is directed towards the joint. The strap-like loops are arranged so that they transmit the alternating loads occurring on the shear load dowel onto the end plate. This is achieved by the strap-like design of the loops 5. The strap-like loops 5 may be designed in various shaping forms. They may have the same width as the end plates 4 or be narrower or wider than the end plates 4. In the embodiment according to FIG. 4 the strap-like loop 5 has the same width as the end plate 4, while the remaining embodiments show the strap-like loops narrower than the end plate 4. The shear load dowel 1 and the shear load dowel bearing bush 2 may pass through the strap-like loop 5, as shown by the embodiments according to the FIGS. 1 and 4, or they may be embraced by the loops 5 as shown by the embodiment according to FIG. 2. In both variants the loops 5 have strap-like functions, as shown in the embodiment according to FIG. 3. Each side has two straps which together form a closed force system with the end plate 4. At the upper end of the one end plate there engages a strap-like loop 5' which extends up to below the shear load dowel bearing bush 2. This results in a bearing design similar to a suspension bridge, for loadings in the one direction, while second strap-like loops 5" extend from the lower end of the end plate 4 up to the upper region of the shear load dowel bearing bush 2. The strap-like loops run laterally past the shear load dowel bearing bush 2. The same also applies to the oppositely lying side where the straplike loops 5' and 5" instead of being connected to the shear load dowel bearing bush 2 are connected directly to the shear load dowel.

Figure 2A:
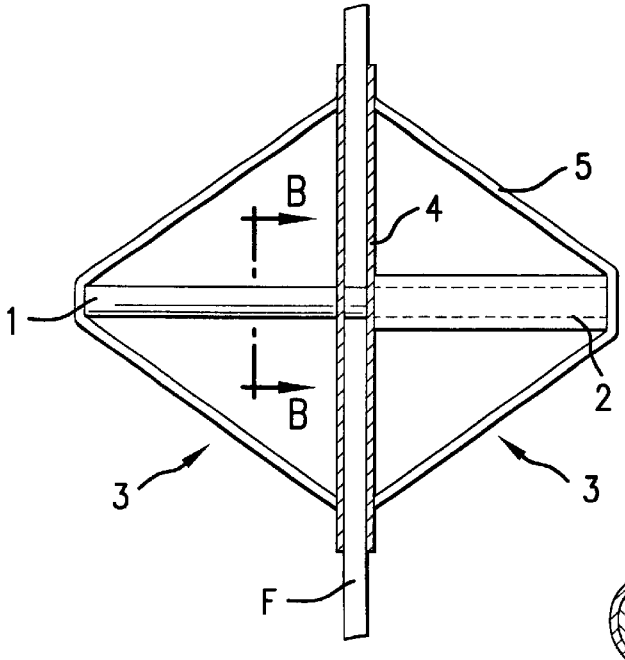
FIG. 2*a* shows the same view as FIG. 1*a,* but of a second embodiment.
Figure 2B:
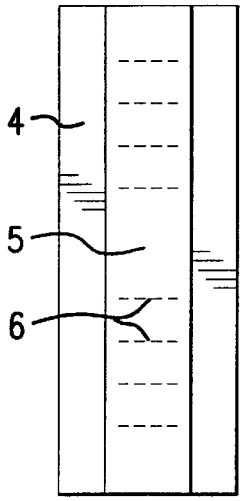
FIG. 2*b* shows the same view as FIG. 1*b* of the embodiment according to FIG. 2*a;*
Figure 3A:
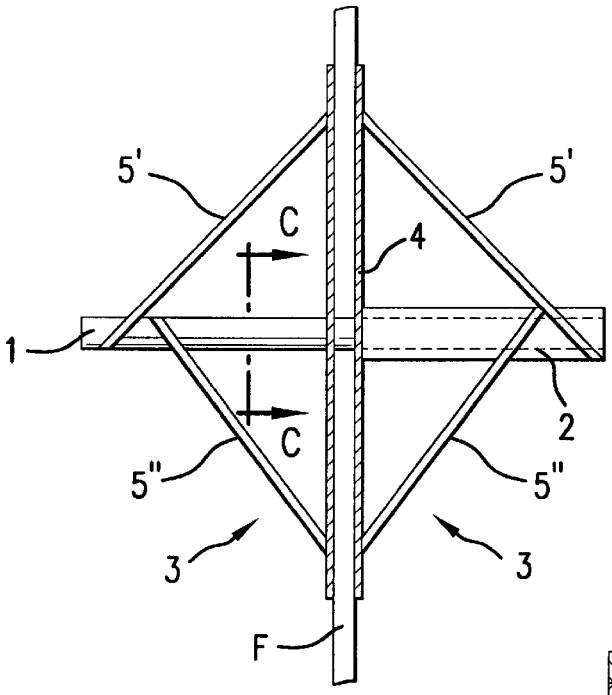
FIG. 3*a* shows another embodiment of a shear load dowel mounting as shown in FIG. 1*a;*
Figure 3B:
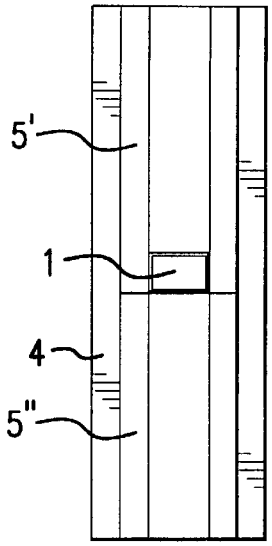
FIG. 3*b* shows a rear-side view as shown in FIG. 1*b* but corresponding to the embodiment according to FIG. 3*a;*
Figure 3C:
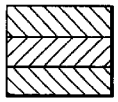
FIG. 3*c* shows a section of the shear load dowel shown in FIG. 3*a,* along the line C—C.
Figure 4A:
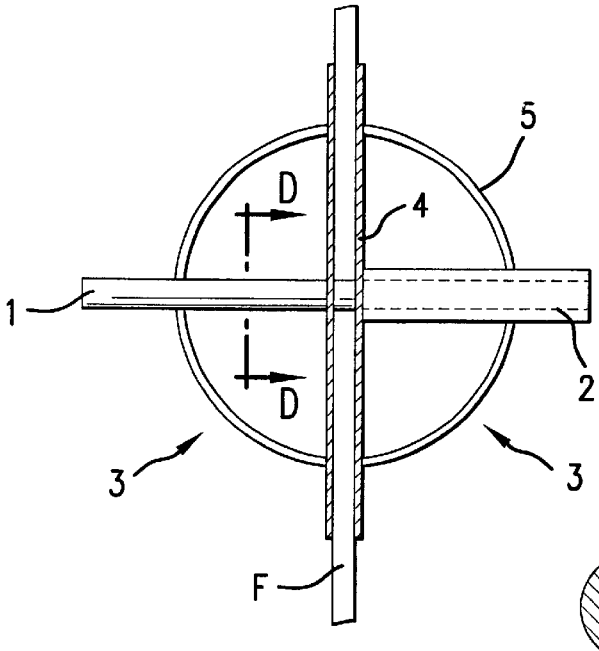
FIG. 4*a* shows another embodiment of this invention as shown in FIG. 1*a;*
Figure 4B:
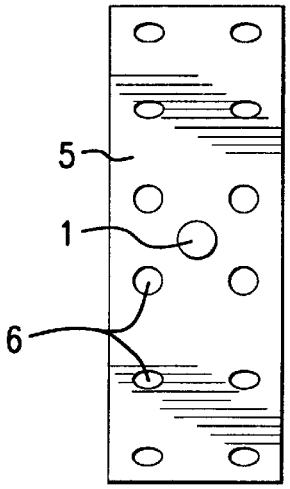
Figure 4C:
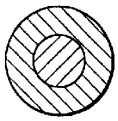
* and FIG. 4*c* shows a cross section taken through the shear load dowel shown in FIG. 4*a,* along line D—D.

The possible shapes of the strap-like loops 5 in a side view may for example be trapezoidal, wherein one preferably selects the shape of an equilateral trapezoidal with a height that may be different, as shown by the dashed line in the component B. The shape of the strap-like loops 5 however may be also roughly the shape of a triangle as shown in FIG. 2*a*. This shape may also be achieved when the shear load dowel or the shear load dowel bearing bush in each case pass through the single strap-like loop 5. The strap-like loop 5 may also be shaped semicircularly as FIG. 4*a* shows. In order, during the casting, to prevent the possible formation of bubbles within the bearing housing 3, the strap-like loops 5 preferably have bleeding bores or bleeding holes 6 of any size and any number as is shown by the various embodiment forms.

For the transmission of the dynamic loadings the multi-layered design of the shear load dowel 1 is required. Only with the multi-layered design of the shear load dowels can there be achieved the physical properties, specifically the demanded ability to be alternately loaded, paired with the high compressive strength, shear strength and elasticity values. Shear load dowels with a mono-ferrite cross section i.e. shear load dowels which in their entirety are of one metal or one metal alloy and of one piece have not mustered these desired pairings of the physical properties. Up to now multi-layered shear load dowels were used essentially for reasons of cost as well as for reasons of corrosion protection. With this laminar construction, the physical properties of the shear load dowel may be set such that shear load dowel mountings may be constructed, which are capable of transmitting the dynamic loadings.

As a rule the shear load dowels according to this invention may also be manufactured multi-layered with all common known cross-sectional shapes. The most common cross-sectional shapes such as cylindrical shear load dowels as well as shear load dowels with a rectangular or square cross section are possible. While a shear load dowel with a rectangular or square cross section principally may be formed of a layering of at least two plate-like rods, three or more layers are preferred. With this the outermost layer may also be formed as an embracing casing. Also the connection between the plate-shaped rods to a shear load dowel may be of the most differing nature. Apart from adhesive and welding connections also connections with a positive and/or friction fit are also considered. With this, assemblies of plates may arise similar to multi-layered leaf springs, wherein the individual bearings for example may be connected to one another with a positive fit by rivets or pins interspersing them, or comprise lateral recesses for a connection by way of a hooping.

With the cylindrical embodiment forms of the shear load dowels, likewise two or multi-layered designs are considered. With this the diameter ratios depending on the choice of material combination plays a suitable part. The design can depend on the forces and movements to be expected. Dynamic loadings on shear load dowel mountings indeed occur in very varied applications from shear load dowels which connect road concrete slabs and ground plates in multi-story carparks to complex concrete designs, such as tunnel pipes or concrete channels. In all these applications there may be alternating loads occurring faster or slower which may only be adequately accommodated with shear load dowel mountings designed for dynamic loadings. Until now, there have been over-dimensioned shear load dowel mountings, which per se are only designed for static loadings, and the differently directed forces occurring with alternating loadings were summed in order to reach an effective rigid region which thus in turn corresponds to the static loadings.

Figure 2C:
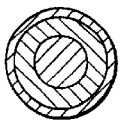
FIG. 2*c* shows a cross section taken through the shear load dowel shown in FIG. 2*a,* along the line B—B.

As shown in FIG. 2*c* also one cylindrically formed shear load dowel may be manufactured of more than two layers. For this purpose the method known from European Patent Reference 0 765 967 is not so suitable. In a particularly interesting method for manufacturing such shear load dowels, over a central cylindrical rod is slided a first tube which surrounds this rod with a certain play and then its diameter by way of a hammering method is hammered onto the core completely free of play. An extremely exact rod may be achieved, wherein the friction connection is excellent. Without problem in the same manner a further tube may be pulled over the two-layered core formed in this manner, again with play, wherein again by way of a hammering method the new outermost casing may be hammered onto the already two-layered core. Thus there may be formed a rod of any number of layers which has enormous strengths and physical properties that may be tailored to suit any application.

In most cases one would usually operate with different steel alloys for the various layers. It has however been shown that also when maintaining the steel alloy alone, by way of the multi-layered or multi-ply design of the shear load dowel, considerably improved values may be achieved.

It is not compelling for the core of the shear load dowel to be a rod. Also variants are considered with which the core is an innermost tube and several tubes in several layers are pulled thereover and are hammered. Finally however also the hollow space of the innermost tube for physical reasons or as a corrosion protection may be filled out with a curing mass.

For achieving the dynamic loadability which here is required for the dowel, it is necessary to vary the hardness of the multi-layered dowel between the individual layers. It is possible to design the hardness increasing as well as decreasing from the outside to the inside. For various reasons it is particularly advantageous to select the hardness to increase from the outside to the inside.

For the manufacture of the multi-layered dowel with several layers, wherein the individual layers are arranged tube-like over one another, a particularly If suitable result may be achieved with the manufacture where one pushes on the respective outer layer as a tube with play and thereafter by a known hammering method attaches this to the core with a friction fit. Also here the core may be a rod or a single or multi-layered tube. The material compactings achieved with the hammering method result in a physically better product than a multi-layered dowel formed with a friction fit by way of thermal methods.

What is claimed is:

1. In a shear load dowel mounting for transmitting loads, having a shear load dowel (1), a bearing bush (2), a first bearing housing (3) holding the bearing bush (2) and a second bearing housing (3) holding the shear load dowel (1), the improvement comprising: a first end plate (4), a second end plate (4), the shear load dowel (1) constructed as a multi-layered element and positioned on both sides of a gap formed between the first end plate (4) and the second end plate (4), the shear load dowel (1) slidably mounted within the bearing bush (2), a first strap (5) attached to the first end plate (4) and to the shear load dowel (1), a second strap (5) attached to the second end plate (4) and the bearing bush (2), and at least one of strength values and hardnesses of layers of the multi-layered dowel (1) one of increasing and decreasing from an outside layer to an inside layer of the layers.

2. In the shear load dowel mounting according to claim 1, wherein the multi-layered shear load dowel (1) has an approximately circular cross section.

3. In the shear load dowel mounting according to claim 2, wherein the shear load dowel (1) comprises a core layer of steel and a casing layer of corrosion-resistant steel enclosing the core layer.

4. In the shear load dowel mounting according to claim 2, wherein the layers are formed of a cylindrical core layer and of at least one concentric layer.

5. In the shear load dowel mounting according to claim 4, wherein the core layer is formed by one of a rod and a tube.

6. In the shear load dowel mounting according to claim 4, wherein the core layer is formed by a tube filled with a curing mass.

7. In the shear load dowel mounting according to claim 2, wherein the layers are connected to one another with at least one of a friction fit and a positive fit.

8. In the shear load dowel mounting according to claim 2, wherein at least two of the layers contacting one another are at least partly in adhesive connection with one another.

9. In the shear load dowel mounting according to claim 1, wherein the shear load dowel (1) has a rectangular cross section and the layers run in one of a horizontal arrangement and a vertical arrangement in a longitudinal direction of the shear load dowel (1).

10. In the shear load dowel mounting according to claim 9, wherein the layers are held to one another with a friction fit connection.

11. In the shear load dowel mounting according to claim 9, wherein the layers are held in connection with one another via a positive fit.

12. A shear load dowel according to claim 1, wherein outer layers of the multi-layered shear load dowel (1) are hammered onto a core layer of the layers, wherein a respective outermost layer formed as a tube is slid on and thereafter hammered with a friction fit with respect to the core layer.

13. In the shear load dowel mounting according to claim 1, wherein at least one of the first strap (5) and the second strap (5) is wider than one of the shear load dowel (1) and the bearing bush (2), and one of the shear load dowel (1) and the bearing bush (2) is looped around by a loop formed by one of the first strap (5) and the second strap (5) in a longitudinal extension in a constructional body (B), and a rearward end of one of the shear load dowel (1) and the bearing bush (2) is connected to one of the first strap (5) and the second strap (5) for force transmission.

14. In the shear load dowel mounting according to claim 13, wherein at least one of the first strap (5) and the second strap (5) in a side view has a shape of approximately a semicircle.

15. In the shear load dowel mounting according to claim 1, wherein the shear load dowel mounting connects construction elements ($B_1$, $B_2$) subjected to a dynamic alternating loading.

16. In the shear load dowel mounting according to claim 1, wherein each of the first strap (5) and the second strap (5) is connected to both sides of one of the bearing bush (2) and the shear load dowel (1).

17. In the shear load dowel mounting according to claim 16, wherein one of: the first strap (5) and the second strap (5) are fastened above the shear load dowel (1) on the first end plate (4) and the second end plate (4) and engage on a lower side of one of the shear load dowel (1) and the bearing bush (2); and the first strap (5) and the second strap (5) are arranged below the dowel (1) on the first end plate (4) and the second end plate (4) and with an other end engage on an upper side of one of the bearing bush (2) and the shear load dowel (1).

18. In the shear load dowel mounting according to claim 1, wherein the first strap (5) and the second strap (5) each is formed by a steel tape.

19. In the shear load dowel mounting according to claim 18, wherein the steel tape comprises one of bleeding holes and bleeding bores (6).

20. In the shear load dowel mounting according to claim 1, wherein at least one of the first strap (5) and the second strap (5) is wider than at least one of the shear load dowel (1) and the bearing bush (2), and one of the dowel (1) and the bearing bush (2) passes through one of the first strap (5) and the second strap (5).

21. In the shear load dowel mounting according to claim 20, wherein at least one of the first strap (5) and the second strap (5) in a side view has a shape of one of a trapezoid and a polygon.

22. In the shear load dowel mounting according to claim 20, wherein the first strap (5) and the second strap (5) in a side view each has a shape of approximately a semicircle.

* * * * *